US007311413B1

(12) United States Patent
Barnes

(10) Patent No.: US 7,311,413 B1
(45) Date of Patent: Dec. 25, 2007

(54) HELMET LIGHTING DEVICE

(76) Inventor: Mark E. Barnes, 3134 Rossevelt Rd., Yuba City, CA (US) 95993

( * ) Notice: Subject to any disclaimer, the term of this patent is extended or adjusted under 35 U.S.C. 154(b) by 45 days.

(21) Appl. No.: 11/209,606

(22) Filed: Aug. 24, 2005

(51) Int. Cl.
*F21V 21/084* (2006.01)

(52) U.S. Cl. ..... 362/106; 362/191; 362/240

(58) Field of Classification Search ..... 362/105, 362/106, 191, 234, 240
See application file for complete search history.

(56) References Cited

U.S. PATENT DOCUMENTS

| | | | |
|---|---|---|---|
| 3,302,018 | A | 1/1967 | Harding |
| 4,199,802 | A | 4/1980 | Malm |
| 4,231,079 | A | 10/1980 | Heminover |
| 5,408,393 | A | 4/1995 | Becker |
| 5,469,342 | A | 11/1995 | Chien |
| D375,612 | S | 11/1996 | Elder |
| 5,667,294 | A | 9/1997 | Lo |
| 5,688,039 | A | 11/1997 | Johnson |
| 5,836,673 | A | 11/1998 | Lo |
| D433,776 | S | 11/2000 | Scanlon |
| 6,575,588 | B2 | 6/2003 | Strehl |
| 6,619,831 | B2 | 9/2003 | Kanesaka |
| 2002/0118532 | A1 | 8/2002 | Gates |
| 2004/0240199 | A1 | 12/2004 | Burnidge |
| 2005/0099799 | A1* | 5/2005 | Cugini et al. ..... 362/105 |

* cited by examiner

*Primary Examiner*—Stephen F Husar
(74) *Attorney, Agent, or Firm*—Theodore J. Bielen, Jr.

(57) ABSTRACT

A lighting device for use with a helmet, having a fastening site and a plurality of lamps. A base member is employed and includes at least one support that projects from the same. The support holds at least one lamp. A flexible sheath extends over the support, the lamp, and at least a portion of the base member to form an enclosure. The sheath possesses an opening to allow light to pass from the lamp to the exterior of the sheath. The sheath also includes an outer surface of frictional material to allow the sheath to be frictionally fixed in at least a first and second position at the surface of the helmet. A fastener links the sheath to the helmet.

12 Claims, 4 Drawing Sheets

10
44
45
54
26
74
75
76
56

HELMET LIGHTING DEVICE

BACKGROUND OF THE INVENTION

The present invention relates to a novel and useful helmet lighting device.

Headlamps and lamps affixed to helmets are often necessary for persons to operate or work in dark spaces, since a lighting apparatus of this nature frees up both hands of the user. However, helmet mounted lights, in the past, have been difficult to focus or to adjust the projection of the beam of light therefrom. In addition, helmet lights are often not amenable to being interchangeable with different models or types of helmets, thus being usable with only a single helmet design.

In the past, various types of helmet lights have been devised. For example, U.S. Pat. Nos. 5,469,342, 6,619,831, and Des. 375,612 show light strip apparatuses which may be used in various applications.

U.S. Patent Publication 2004/0240199 reveals a strip lighting mechanism which illuminates the handle of a container.

U.S. Pat. Nos. 5,667,294, 5,836,673, and 6,575,588 describe strip lamp mechanisms which may be worn across the head of a user.

U.S. Pat. Nos. 3,302,018, 4,199,802, and Publication Number US2002/0118532 illustrate helmet lamps which are mounted to provide light to persons wearing the helmet.

U.S. Pat. No. 4,231,079 shows a helmet having a belt including a plurality of lights that run longitudinally across the top of a helmet.

U.S. Des. Pat. 433,776 include a helmet having positions to allow lighting at various faces of a helmet.

U.S. Pat. Nos. 5,408,393 and 5,688,039 teach helmets having lights at or near the top of the helmet to provide illumination to allow the user to work or observe items in a dark place.

A lighting device for use with a helmet having accurate focusing and light directing qualities would be a notable advance in the art of environmental controls or operations in darken spaces.

BRIEF SUMMARY OF THE INVENTION

In accordance with the present invention a novel and useful lighting device for use with a helmet is herein provided.

The device of the present invention utilizes a base member which is generally elongated and extends along a certain distance. The base member may be bendable to conform to the outer surface of a particular helmet upon which it is being used. At least one support projects from and is connected to the base member. The support is capable of holding at least one lamp and may be formed to hold a plurality of lamps. For example, LED lamps may be used in conjunction with the support of the present invention. In addition, a plurality of supports may be used with the base member of the present invention to hold one or more lamps in a particular configuration. A series of slots may be formed in the base member to permit bending of the base member along said slots. Such slots may be positioned between supporting members where plurality of supporting members is found in the lighting device of the present invention.

A sheath extends over the support, the lamp, and at least a portion of the base member to form an enclosure. Such enclosure protects the lamp and any supporting electrical connectors feeding electricity to the lamp within said enclosure. The sheath may be formed of a flexible material which is also non-electrically conductive in this regard. An opening is provided in the sheath for each lamp employed with the base member and support or supports connected to the base member. Each one of the openings allows light to shine from the lamp to the exterior of the sheath. The sheath also includes an exterior surface which frictionally engages the surface of the helmet. For example a rubberized material may be employed to achieve this result. Thus, the sheath, enclosing the base member, support, and lamp, may move between a first position and a second position on the exterior of the helmet. Such movement into these positions facilitates the directing of light of the lamps to a particular place to allow the user of the device of the present invention to identify items and to manipulate such items as is needed in the electrical, plumbing, construction, and other arts.

A fastener links the sheath to the helmet fastening site. The fastener may take the form of a loop which is capable of forming a closed loop upon itself by the use of a connecting member such as hook and pile material, snaps, buttons, magnets, and the like. A source of power may also be mounted on the base member and include conductors which provide electrical power to the lamp or lamps held to the base member by the support or supports.

It may be apparent that a novel and useful lighting device has been hereinabove described.

It is therefore an object of the present invention to provide a lighting device which is easily adaptable to multiple types of helmets for use in darkened spaces.

A further object of the present invention to provide a lighting device which is capable of being fastened to a helmet and is adjustable on the outer surface of the helmet to provide directing of the light in various trajectories as is needed by the user of the device.

Another object of the present invention to provide a lighting device for use with a helmet which allows the use of LED lamps and provides accurate directing of the light from the LED lamps as the position of the lighting device is adjusted over the top surface of the helmet.

A further object of the present invention to provide a lighting device for use with a helmet which prevents water damage to the components of the lighting device.

A further object of the present invention to provide a lighting device for use with a helmet which lights a work area and allows the user to employ both hands for work or other types of operations.

Another object of the present invention to provide a lighting device which is lightweight and includes supports for LEDs which also protect the LEDs from damage.

Yet another object of the present invention to provide a lighting device for use with a helmet which is lightweight and portable and does not affect the balance of the helmet on the head of the user.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior delineated drawings.

Figure 1:
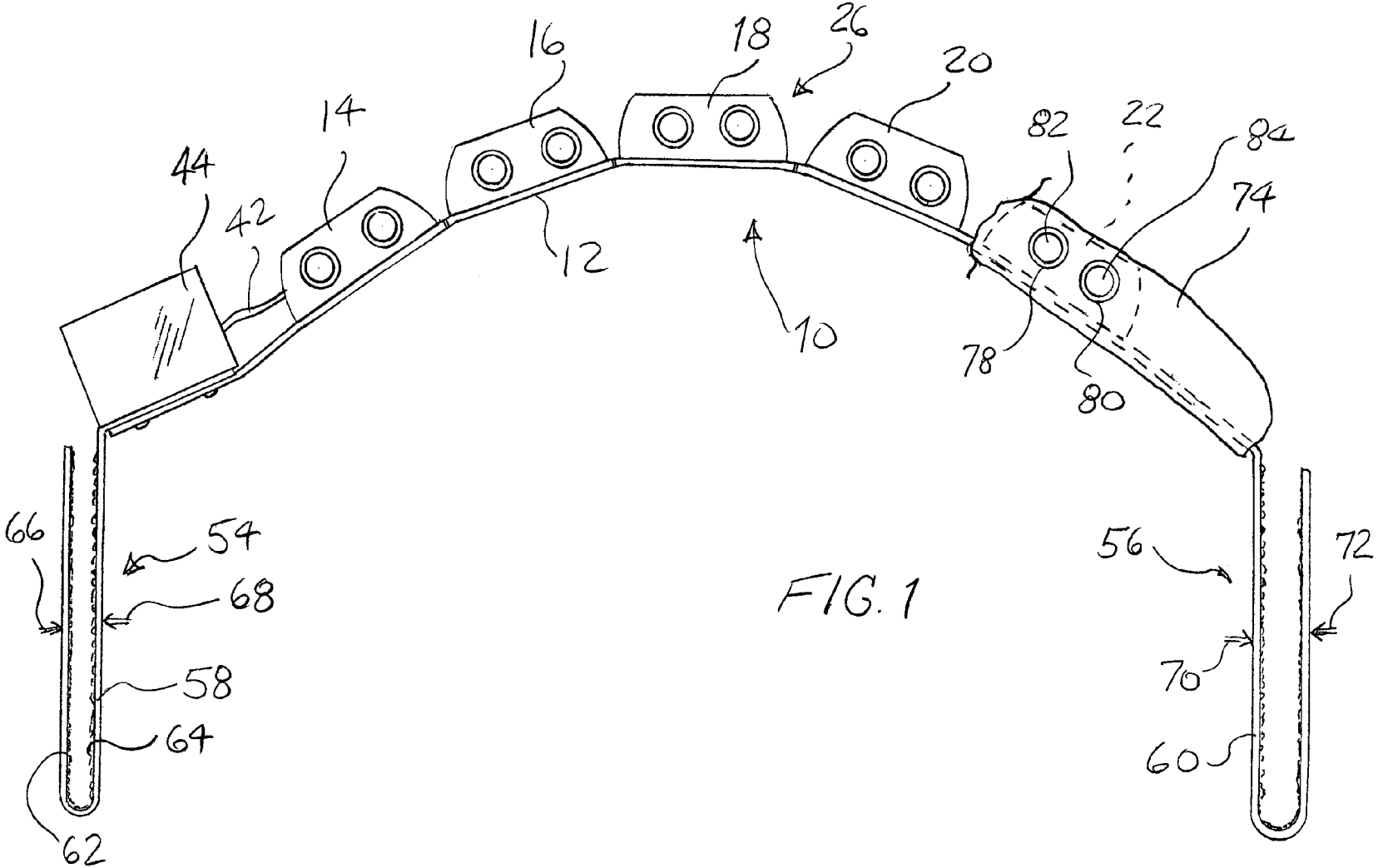
FIG. 1 is a front elevational view of the device of the present invention, showing the enclosing sheath in portion.

A preferred embodiment of the invention is shown in the drawings, as a whole, by reference character 10. Lighting device 10, FIG. 1 includes as one of its elements a base member 12 which is shown as generally flattened member extending along a certain 1:0 distance. Base member 12 may further be formed into a metallic member and is preferably bendable. As depicted in FIG. 1, base member 12 has been configured into a generally arcuate configuration by bending base member 12. Thus, base member 12 is generally elongated and extends along a certain distance depending on its use and application.

Figure 3:
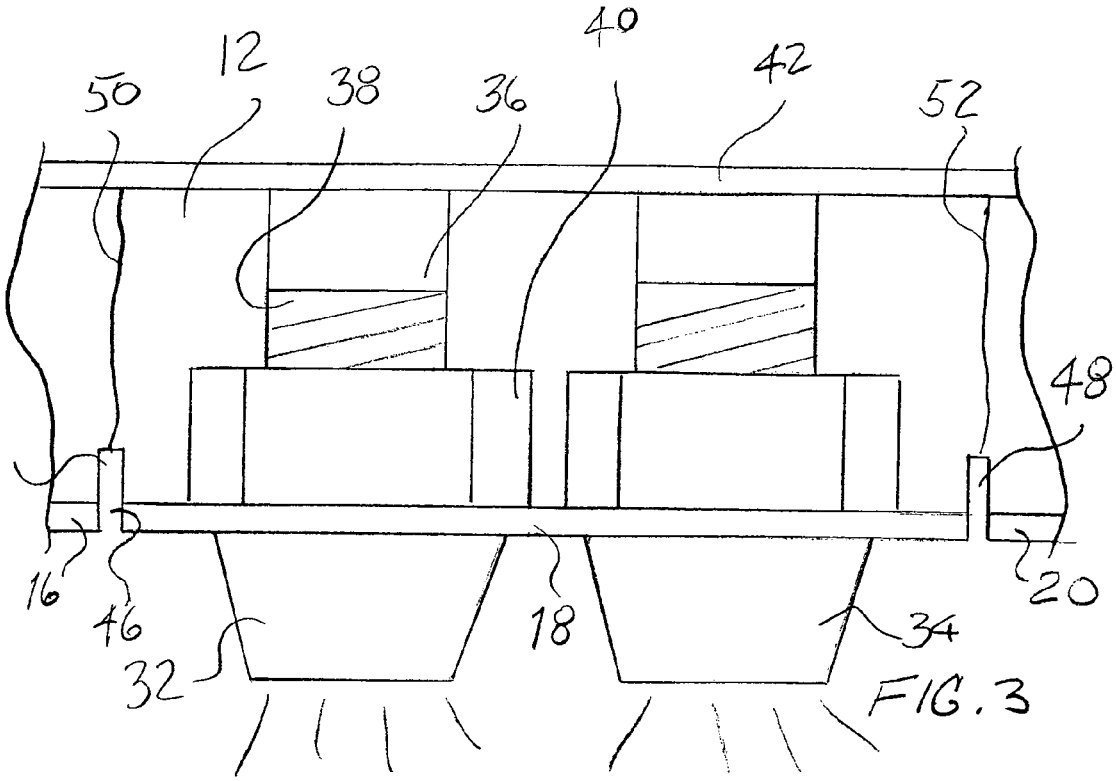
FIG. 3 is a top plan view of a portion of the device of the present invention depicting the support and a pair of LEDs along the base member.
Figure 4:
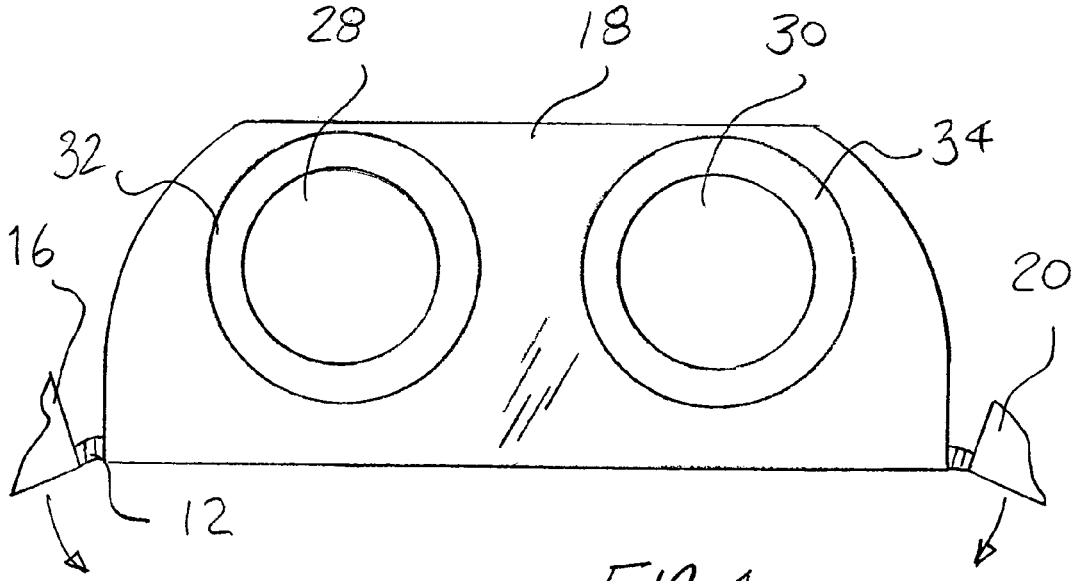
FIG. 4 is a front elevation view of the portion of the device of FIG. 3 and illustrating the bendable feature of the base member.

Supports 14, 16, 18, 20, and 22 are also included in the present invention. Each support is generally formed into a flat trapezoid-like member. In many cases, supports 14, 16, 18, 20, and 22 are coplanar along base member 12. Plurality of LED lamps 26 are held by supports 14, 16, 18, 20, and 22, which are fixed to base member 12 or fashioned as a unitary member with base member 12. Lamps 16 are particularly useable with the present invention since true colors of illuminated objects are perceptible to a user of device 10. With reference to FIGS. 3 and 4, it may be observed that support 18 is shown in detail with LED lamps 28 and 30. Lamps 28 and 30 are surrounded by shields 32 and 34, respectively. Shields 32 and 34 may each take the form of a truncated conical metallic member. With respect to LED 28 and shield 32 on FIG. 3, lamp 28 includes a body 36 having a threaded portion 38. Nut 40 holds body 36 in place and positions LED 28 as shown in FIGS. 3 and 4 when tightened against support 18. Electrical conductors 42 contact body 38 and carry electrical energy from battery pack 44, having switch 45, mounted to base member 12, FIGS. 1 and 2. The same structure described with respect to LED 28 is found in each of the plurality of LEDs 26, including LED 30 depicted in FIGS. 3 and 4. In addition, it may be observed on FIGS. 3 and 4 that slots 46 and 48 bias the articulation of base member 12 into the arcuate configuration shown in FIG. 1. Bend lines 50 and 52 indicate the folding of portions of base member 12, in this regard.

Fasteners 54 and 56 are also depicted on FIG. 1 in the form of open loops 58 and 60 made of flexible material such as cloth, rubber, leather, and the like. Open loops 58 and 60 are formed with fastening layers such as fastening layers 62 and 64, of hook and pile material, shown with respect to open loop 58. Directional arrows 66 and 68 indicate the closure of open loop 58 into a closed loop around a ring or other fastening site of helmet 86, FIG. 5, which will be discussed in greater detail hereinafter. It should be noted that open loop 56 includes the same structure as open loop 58, such that a closed loop may be formed according to directional arrows 70 and 72.

Figure 2:
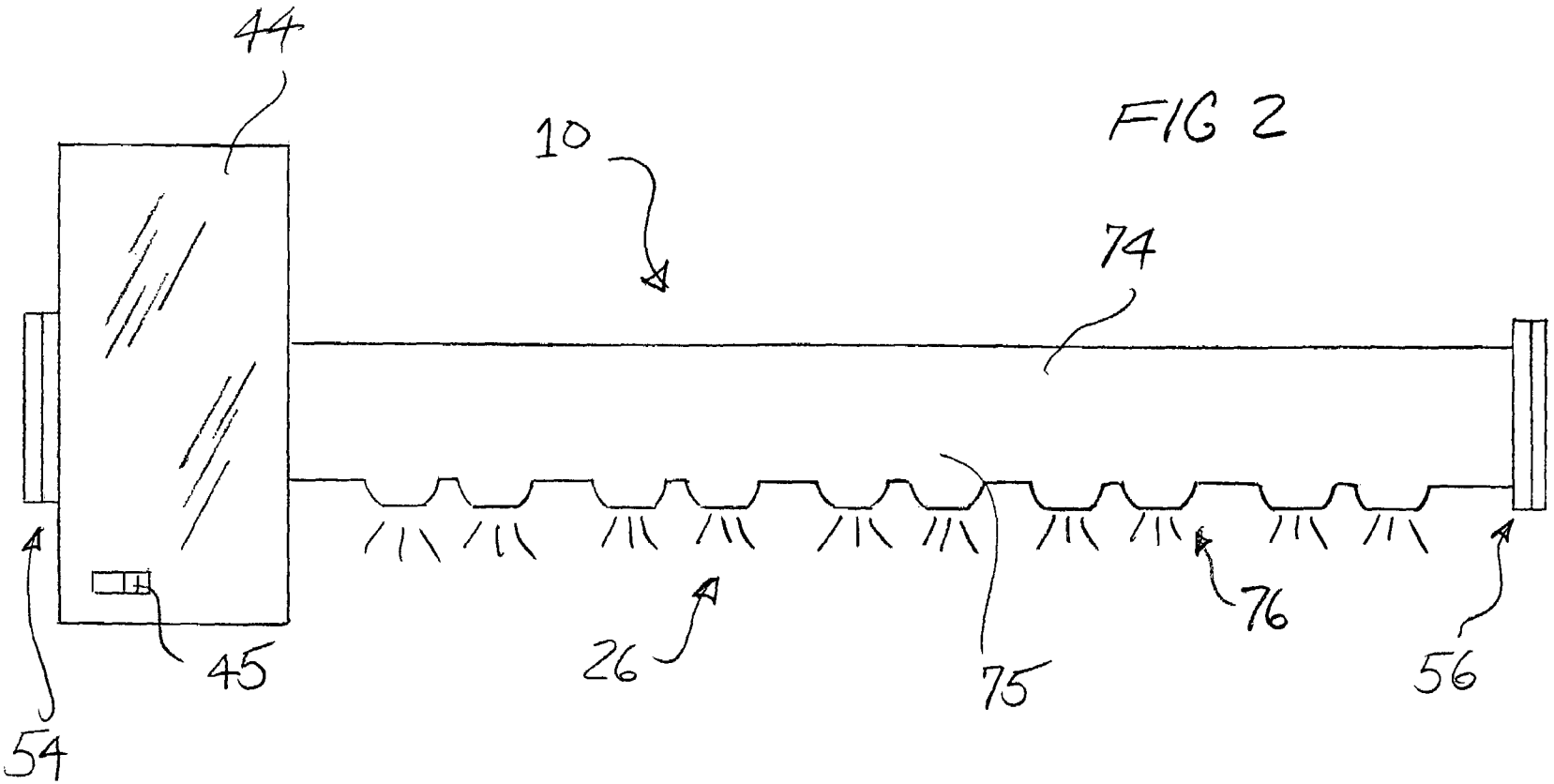
FIG. 2 is a top plan view of the device of the present invention in which the enclosing sheath is shown in whole.

As depicted in FIGS. 1 and 2, a flexible sheath 74 is intended to extend over and protect base member 12, supports 14, 16, 18, 20, and 22, and plurality of LED's 26. The flexibility of sheath 74 also allows the bending of base member 12 and electrically isolates lamps 26 and conductors 42. In FIG. 1, sheath 74 is partially shown, while in FIG. 2, it is depicted as having completely covered these elements. A plurality of openings 76 through sheath 74 allows the conduction of light from plurality of LEDs 26 to the exterior of device 10. Ray lines are depicted on FIG. 2 in this regard. Sheath 74 includes an outer frictional surface 75. For example, sheath 74 may be constructed of rubberized material. Returning to FIG. 1, it may be observed that openings 78 and 80 are shown for LEDs 82 and 84.

Figure 5:
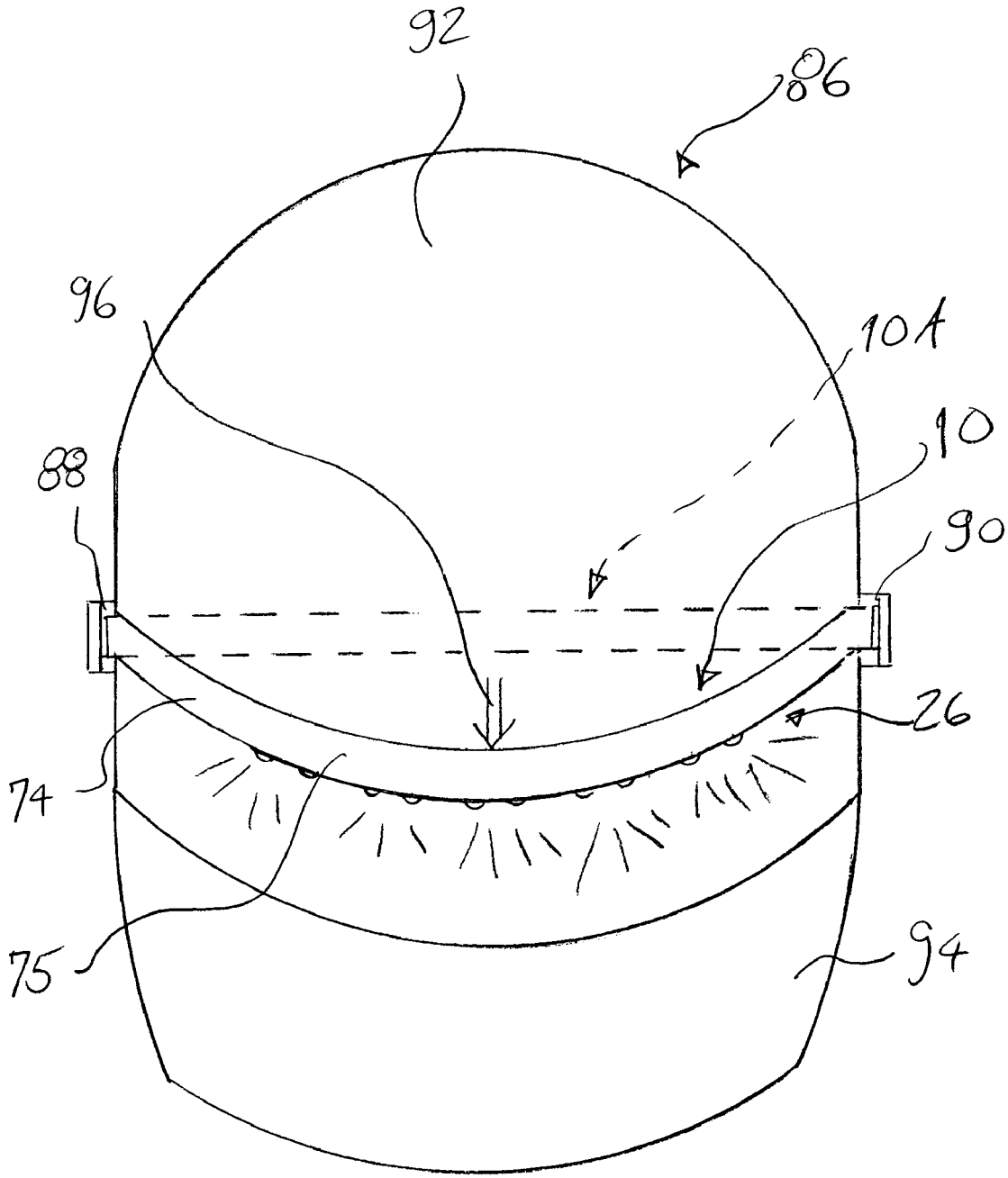
FIG. 5 is a top plan view of a helmet in which the device of the present invention has been fastened and is movable from a first position to at least a second position.

In operation, the user places device 10 on a helmet such as that shown in plan view as helmet 86, FIG. 5. Fasteners 54 and 56 are slipped through slotted protuberances 88 and 90 of helmet 86 to allow the extension of device 10 across the top portion 92 of helmet 86. Device 10 conforms to this orientation since sheath 74 may be formed of a flexible material and is capable of frictionally engaging the top portion of helmet 92. Device 10 may be adjustably affixed to multiple places atop 92 of helmet 86. FIG. 5 represents device 10A in phantom showing the device of the present invention extending across the top 92 of helmet 86. On the other hand, the device of the present invention 10 shown as in solid lines as being moved closer to the brim 94 of helmet 86. Frictional engagement of sheath 74 with top portion 92 of helmet 86 maintains device 10 in that position. Directional arrow 96 indicates such movement of device 10 between a first and second position. It should be noted, that the movement of device 10 across the top of 92 of helmet 86 toward brim 94 changes the direction of shinning of the plurality of LEDs 26 from device 10 from a higher position in front of the user to a lower position in front of the user. Of course, device 10 may be continuously adjusted in this manner to provide the proper projection of light to a work piece or other article of interest to the user of device 10.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A lighting device used with a helmet having a fastening site and a plurality of lamps, comprising:

a. a base member, said base member extending along a certain distance;

b. at least one support projecting from said base member, said support holding at least one lamp;

c. a sheath extending over said support, the lamp, and at least a portion of said base member to form an enclosure, said sheath including an opening therethrough for conducting light from the lamp to the exterior of said sheath, said sheath including an outer surface capable of frictionally engaging the helmet said sheath being movable and fixable relative to said helmet by said frictional engaging of the helmet, said sheath being capable of assuming a first position and at least a second position on the exterior of the helmet; and d. a fastener for linking the sheath to the helmet fastening site.

2. The device of claim 1 in which said sheath is flexible.

3. The device of claim 1 in which said base member is bendable.

4. The device of claim 3 in which said base member further includes at least one slot to bias bending of said base member at said slot.

5. The device of claim 1 which further comprises a source of power for the lamp mounted relative to said base member.

6. The device of claim 2 in which said sheath is composed of non-electrically conducting material.

7. The device of claim 1 in which said fastener comprises a loop selectively extending from said base member and said sheath, said loop including a portion for forming said loop into a closed loop.

8. The device of claim 7 in which said sheath is flexible.

9. The device of claim 7 in which said base member is bendable.

10. The device of claim 7 in which said base member further includes at least one slot to bias bending of said base member at said slot.

11. The device of claim 7 which further comprises a source of power for the lamp mounted relative to said base member.

12. The device of claim 8 in which said sheath is composed of non-electrically conducting material.

* * * * *